US006427774B2

(12) United States Patent
Thomas et al.

(10) Patent No.: US 6,427,774 B2
(45) Date of Patent: Aug. 6, 2002

(54) PROCESS AND APPARATUS FOR COUPLED ELECTROMAGNETIC AND ACOUSTIC STIMULATION OF CRUDE OIL RESERVOIRS USING PULSED POWER ELECTROHYDRAULIC AND ELECTROMAGNETIC DISCHARGE

(75) Inventors: Sally A. Thomas, Harris County; William W. Gilbert, Katy; Alan Royce Huffman, The Woodlands, all of TX (US)

(73) Assignee: Conoco Inc., Houston, TX (US)

( * ) Notice: Subject to any disclaimer, the term of this patent is extended or adjusted under 35 U.S.C. 154(b) by 7 days.

(21) Appl. No.: 09/755,228

(22) Filed: Jan. 5, 2001

Related U.S. Application Data

(63) Continuation-in-part of application No. 09/500,669, filed on Feb. 9, 2000, now Pat. No. 6,227,293.

(51) Int. Cl.[7] ..... E21B 43/25; E21B 28/00
(52) U.S. Cl. ..... 166/248; 166/177.2
(58) Field of Search ..... 166/248, 249, 166/370, 177.1, 177.2, 177.6, 177.7

(56) References Cited

U.S. PATENT DOCUMENTS

| | | | |
|---|---|---|---|
| 2,670,801 A | 3/1954 | Sherborne | 166/21 |
| 2,799,641 A | 7/1957 | Bell | 240/180 |
| 3,141,099 A | 7/1964 | Brandon | 310/4 |
| 3,169,577 A | 2/1965 | Sarapuu | 166/42 |
| 3,378,075 A | 4/1968 | Bodine | 166/45 |

(List continued on next page.)

OTHER PUBLICATIONS

Robert N. Maddox; Chapter 14, Lease–Operated Hydrocarbon Recovery Systems, Petroleum Engineering Handbook, 1992, pp. 1–22.
H. Vernon Smith; Chapter 12, Oil and Gas Separators. Petroleum Engineering Handbook, 1992, pp. 1–4.

*Primary Examiner*—David Bagnell
*Assistant Examiner*—Jennifer R. Dougherty
(74) *Attorney, Agent, or Firm*—Madan, Mossman & Sriram P.C.

(57) ABSTRACT

Pulsed power sources are installed in one or more wells in the reservoir interval. The pulse sources include (1) an electrohydraulic generator that produces an intense and short lived electromagnetic pulse that travels at the speed of light through the reservoir, and an acoustic pulse from the plasma vaporization of water placed around the source that propagates through the reservoir at the speed of sound in the reservoir and (2) an electromagnetic generator that produces only an intense and short lived electromagnetic pulse that travels at the speed of light through the reservoir. The combination of electrohydraulic and electromagnetic generators in the reservoir causes both the acoustic vibration and electromagnetically-induced high-frequency vibrations occur over an area of the reservoir where stimulation is desired. Single generators and various configurations of multiple electrohydraulic and electromagnetic generators stimulate a volume of reservoir and mobilize crude oil so that it begins moving toward a producing well. The method can be performed in a producing well or wells, an injector well or wells, or special wells drilled for the placement of the pulsed power EOR devices. The method can be applied with other EOR methods such as water flooding, CO2 flooding, surfactant flooding, diluent flooding in heavy oil reservoirs. The recovered formation fluids may be separated into various constituents.

25 Claims, 12 Drawing Sheets

U.S. PATENT DOCUMENTS

| | | | | |
|---|---|---|---|---|
| 3,507,330 | A | 4/1970 | Gill | 166/248 |
| 3,599,438 | A | 8/1971 | Blackwell et al. | 62/22 |
| 3,754,598 | A | 8/1973 | Holloway, Jr. | 166/249 |
| 3,874,450 | A | 4/1975 | Kern | 166/248 |
| 3,893,918 | A | 7/1975 | Favret, Jr. | 210/84 |
| 3,920,072 | A | 11/1975 | Kern | 166/248 |
| 3,936,371 | A | 2/1976 | Ueda et al. | 208/251 H |
| 3,952,800 | A | 4/1976 | Bodine | 166/249 |
| 4,049,053 | A | 9/1977 | Fisher et al. | 166/249 |
| 4,074,758 | A | 2/1978 | Scott | 166/249 |
| 4,084,638 | A | 4/1978 | Whiting | 166/248 |
| 4,164,978 | A | 8/1979 | Scott | 166/249 |
| 4,345,650 | A | 8/1982 | Wesley | 166/249 |
| 4,437,518 | A | 3/1984 | Williams | 166/248 |
| 4,441,900 | A | 4/1984 | Swallow | 62/29 |
| 4,466,484 | A | 8/1984 | Kermabon | 166/60 |
| 4,471,838 | A | 9/1984 | Bodine | 166/249 |
| 4,589,896 | A | 5/1986 | Chen et al. | 62/28 |
| 4,805,697 | A | 2/1989 | Fouillout et al. | 166/265 |
| 4,884,634 | A | 12/1989 | Ellingsen | 166/248 |
| 4,904,942 | A | 2/1990 | Thompson | 324/323 |
| 4,923,493 | A | 5/1990 | Valencia et al. | 62/13 |
| 5,041,209 | A | 8/1991 | Cha et al. | 208/251 R |
| 5,224,350 | A | 7/1993 | Mehra | 62/17 |
| 5,282,508 | A | 2/1994 | Ellingsen et al. | 166/249 |
| 5,486,764 | A | 1/1996 | Thompson et al. | 324/323 |
| H1561 | H | 7/1996 | Thompson | 367/188 |
| 5,735,936 | A | 4/1998 | Minkkinen et al. | 95/49 |
| 5,860,476 | A | 1/1999 | Kjos | 166/265 |
| 5,877,995 | A | 3/1999 | Thompson et al. | 367/14 |
| 5,983,663 | A | 11/1999 | Sterner | 62/620 |
| 6,085,549 | A | 7/2000 | Daus et al. | 62/624 |
| 6,131,407 | A | 10/2000 | Wissolik | 62/606 |

PROCESS AND APPARATUS FOR COUPLED ELECTROMAGNETIC AND ACOUSTIC STIMULATION OF CRUDE OIL RESERVOIRS USING PULSED POWER ELECTROHYDRAULIC AND ELECTROMAGNETIC DISCHARGE

CROSS REFERENCES TO RELATED APPLICATIONS

This application is a continuation-in-part of U.S. patent application Ser. No. 09/500,669, filed on Feb. 9, 2000, now U.S. Pat. No. 6,227,293.

BACKGROUND OF THE INVENTION

1. Field of the Invention

The present invention pertains to the stimulation of crude oil reservoirs to enhance production using a combination of pulsed power electrohydraulic and electromagnetic methods and the processing of the recovered crude oil into its components. In particular, the present invention provides a method and apparatus for recovery of crude oil from oil bearing soils and rock formations using pulsed power electrohydraulic and electromagnetic discharges in one or more wells that produce acoustic and coupled electromagnetic-acoustic vibrations that can cause oil flow to be enhanced and increase the estimated ultimate recovery from reservoirs.

2. Background of the Invention

The stimulation of crude oil reservoirs to enhance oil production from known fields is a major area of interest for the petroleum industry. One of the single most important research goals in fossil fuels is to recover more of the hydrocarbons already found. At present, approximately 66% of discovered oil is left in the ground due to the lack of effective extraction technology for secondary and tertiary Enhanced Oil Recovery (EOR). A EOR technology that can be deployed easily and at low cost in onshore and offshore field locations would greatly improve the performance of many oil fields and would increase significantly the world's known recoverable oil reserves.

Methods that are widely used for the purpose rely on the injection of fluid at one well, called the injection well, and use of the injected fluid to flush the in situ hydrocarbons out of the formation to a producing well. In one mode of secondary recovery, a gas such as $CO_2$ that may be readily available and inexpensive, is used. In other modes, water or, in the case of heavy oil, steam may be used to increase the recovery of hydrocarbons. One common feature of such injection methods is that once the injected fluid attains a continuous phase between the injection well and the production well, efficiency of the recovery drops substantially and the injected fluid is unable to flush out any remaining hydrocarbons trapped within the pore spaces of the reservoir. Addition of surfactants has been used with soome success, but at high cost, both economic and environmental.

Many methods have been developed that try address the problem of driving out the residual oil. They can be divided into a number of broad categories.

The first category uses electrical methods. For example, U.S. Pat. No. 2,799,641 issued to Bell discloses a method for enhancing oil flow through electrolytic means. The method uses direct current to stimulate an area around a well, and uses the well-documented effect known as electro-osmosis to enhance oil recovery. Another example of electro-osmosis is described in U.S. Pat. No. 4,466,484 issued to Kermabon wherein direct current only is used to stimulate a reservoir. U.S. Pat. No. 3,507,330 issued to Gill discloses a method for stimulating the near-wellbore volume using electricity passed upwards and downwards in the well using separate sets of electrodes. U.S. Pat. No. 3,874,450 issued to Kern teaches a method for dispersing an electric current in a subsurface formation by means of an electrolyte using a specific arrangement of electrodes. Whitting (U.S. Pat. No. 4,084,638) uses high-voltage pulsed currents in two wells, a producer and an injector, to stimulate an oil-bearing formation. It also describes equipment for achieving these electrical pulses.

A second category relies on the use of heating of the formation. U.S. Pat. No. 3,141,099 issued to Brandon teaches a device installed at the bottom of a well that causes resistive heating in the formation though dielectric or arc heating methods. This method is only effective within very close proximity to the well. Another example of the use of heating a petroleum bearing formation is disclosed in U.S. Pat. No. 3,920,072 to Kern.

A third category of methods relies on mechanical fracturing of the formation. An example is disclosed in U.S. Pat. No. 3,169,577 to Sarapuu wherein subsurface electrodes are used to cause electric impulses that induce flow between wells. The method is designed to create fissures or fractures in the near-wellbore volume that effectively increase the drainage area of the well, and also heat the hydrocarbons near the well so that oil viscosity is reduced and recovery is enhanced.

It has long been documented that acoustic waves can act on oil-bearing reservoirs to enhance oil production and total oil recovery. A fourth category of methods used for EOR rely on vibratory or sonic waves, possibly in conjunction with other methods. U.S. Pat. No. 3,378,075 to Bodine discloses a method for inducing sonic pumping in a well using a high-frequency sonic vibrator. Although the sonic energy generated by this method is absorbed rapidly in the near wellbore volume, it does have the effect of cleaning or sonicating the pores and fractures in the near-wellbore area and can reduce hydraulic friction in the oil flowing to the well. Another example of a vibratory only technique is disclosed by U.S. Pat. No. 4,049,053 to Fisher et al. wherein several low-frequency vibrators are installed in the well and are driven hydraulically using surface equipment. U.S. Pat. No. 4,437,518 issued to Williams describes the design for a piezoelectric vibrator that can be used to stimulate a petroleum reservoir. U.S. Pat. No. 4,471,838 issued to Bodine teaches a method for using surface vibrations to stimulate oil production. The surface source defined in this patent is not sufficient to produce significant enhanced recovery of crude oil.

Turning next to methods that use vibratory or sonic waves in conjunction with other methods, U.S. Pat. No. 3,754,598 to Holloway, Jr. discloses a method that utilizes at least one injector well and another production well. The method imposes oscillating pressure waves from the injector well on a fluid that is injected to enhance oil production from the producing well. U.S. Pat. No. 2,670,801 issued to Sherborne discloses the use of sonic or supersonic vibrations in conjunction with fluid injection methods: the efficiency of the injected fluids in extracting additional oil from the formation is improved by the use of the acoustic waves. U.S. Pat. No. 3,952,800, also to Bodine teaches a sonic treatment in which a gas is injected into the well and is used to treat the wellbore surface using sonic wave stimulation. The method causes the formation to be heated through the gas by heating from the ultrasonic vibrations. U.S. Pat. No. 4,884,634 issued to Ellingsen uses vibrations of an appropriate frequency at or near the natural frequency of the formation to cause the adhesive forces between the formation and the oil to break down. The method calls for a metallic liquid (mercury) to be placed in the wells to the level of the reservoir and the liquid is vibrated while also using electrodes placed in the wells to electrically stimulate the formation. Apart from the potential environmental hazards associated with the handling and containment of mercury, this method faces the problem of avoiding formation damage due to an excess of borehole pressure over the formation fluid pressure caused by the presence of a dense liquid. U.S. Pat. No. 5,282,508, also issued to Ellingsen et al. defines an acoustic and electrical method for reservoir stimulation that excites resonant modes in the formation using AC and/or DC currents along with sonic treatment. The method uses low frequency electrical stimulation.

The success of the existing art in stimulating reservoirs has been spotty at best, and the effective range of such methods has been limited to less than 1000 feet from the stimulation source. A good discussion on wettability, permeability, capillary forces and adhesive and cohesive forces in reservoirs is provided by the Ellingsen '508 patent. These discussions fairly represent the state of knowledge on these subjects and are not repeated herein. These discussions do not, however, address the limitations on the current state of the art in acoustic stimulation.

Existing acoustic stimulation methods have demonstrated clearly that they are limited to a range of about 1000 feet from the stimulation point. This limit is caused by the natural attenuation properties of the reservoir, which absorb high frequencies preferentially and reduce the effective frequency range to less than a few hundred Hertz at distances beyond about 1000 feet from the acoustic source. This same limit has plagued seismic imaging in cross-borehole studies for many years and is a fundamental physical limitation on all acoustic methods.

Effective acoustic stimulation of oil-bearing reservoirs requires support at greater distances from the stimulation source than possible with most of the prior art. In addition, there is some empirical evidence suggesting that higher frequencies than direct acoustic methods can generate may be more effective in stimulation of oil-bearing reservoirs. Accordingly, it is desirable to have a stimulation source that has a greater range of effectiveness than the prior art discussed above. Such a source should preferably be able to provide stimulation at higher frequencies than the 10–500 Hz typically attainable using prior art methods.

U.S. Pat. No. 4,345,650 issued to Wesley teaches a device for electrohydraulic recovery of crude oil using by means of an electrohydraulic spark discharge generated in the producing formation in a well. This method presents an elegant apparatus that can be placed in the producing interval and can produce a shock and acoustic wave with very desirable qualities. The present invention will build on the teachings of this patent and will extend the effective range of Wesley's method through new and novel equipment designs and field configurations of Wesley's apparatus and new apparatus designed to enhance the effect on oil reservoirs.

Hydrocarbons recovered from a wellbore may include a number of components. The term "crude oil" is used to refer to hydrocarbons in liquid form. The API gravity of crude oil can range from 6° to 50° API with a viscosity range of 5 to 90,000 cp under average conditions. Condensate is a hydroacarbon that may exist in the producing formation either as a liquid or as a condensable vapor. Liquefaction of the gaseous components occurs when the temperature of the recovered hydrocarbons is lowered to typical surface conditions. Recovered hydrocarbons also include free gas that occurs in the gaseous phase under reservoir conditions, solution gas that comes out of solution from the liquid phase when the temperature is lowered, or as condensable vapor. Recovered hydrocarbons also commonly include water that may be in either liquid form or vapor (steam). The liquid water may be free or emulsified: free water reaches the surface separated from liquid hydrocarbons whereas the emulsified water may be either water dispersed as an emulsion in liquid hydrocarbons or as liquid hydrocarbons dispersed as an emulsion in water. Produced well fluids may also include gaseous impurities including nitrogen, helium and other inert gases, $CO_2$, $SO_2$ and $H_2S$. Solids present in the recovered wellbore fluids may include sulphur. Heavy metals such as chromium, vanadium or manganese may also be present in the recovered fluids from a wellbore, either as solids or in solution as salts. In all enhanced EOR operations, it is desirable to separate these and other commercially important materials from the recovered fluids.

SUMMARY OF THE INVENTION

The present invention is a pulsed power device and a method of using the pulsed power device for EOR. Pulsed power is the rapid release of electrical energy that has been stored in capacitor banks. By varying the inductance of the discharge system, energies from 1 to 100,000 Kilojoules can be released over a pulse period from 1 to 100 microseconds. The rapid discharge results in a very high power output that can be harnessed in a variety of industrial, chemical, or medical applications. The energy release from the system can be used either in a direct plasma mode through a spark gap or exploding filament, or by discharging the energy through a single- or multiple-turn coil that generates a short-lived but extremely intense magnetic field.

When electricity stored in capacitors is released across a spark gap submerged in water, a plasma channel is created that vaporizes the surrounding water. This plasma ionizes the water and generates very high pressures and temperatures as it expands outward from the discharge point. In a plasma, or electrohydraulic (EH) mode, the pulse may be used in a wide range of processes including geophysical exploration, mining and quarrying, precision demolition, machining and metal forming, treatment and purification of a wide range of fluids, ice breaking, defensive weaponry, and enhanced oil recovery which is the purpose of the present invention. The basic physics of the shock wave that is generated by the EH discharge is well understood and is documented in U.S. Pat. No. 4,345,650 issued to Wesley, and incorporated herein by reference.

In the electromagnetic (EM) mode, the coil is designed to produce controlled flux compression that can be used to generate various physical effects without the coupled effect of the EH strong acoustic wave. In both systems, however, typical systems require about 0.5 to 1 seconds to accumulate energy from standard power sources. The ratio of accumulation time to discharge time (100,000 to 1,000,000) allows the generation of pulses with several gigawatts of peak power using standard power sources.

Given the physical limitations on direct acoustic stimulation caused by attenuation in natural materials, acoustic stimulation must be generated using wide band vibrations in these materials at distances much greater than the current limitation of about 1000 feet. The present invention addresses this issue in a new and innovative way using pulsed power as the source. The Wesley '650 patent teaches a method for generating strong acoustic vibrations for reservoir stimulation that has been shown in the field to have an effective limit of about 1000 feet. What was not recognized in the Wesley teachings was that the pulsed power method also has a unique ability to generate high-frequency acoustic stimulation of the reservoir separately from the direct acoustic response of the EH shock wave generated by the plasma discharge in the wellbore. In addition to the direct shock wave effect claimed in the Wesley patent, the pulsed power discharge also generates a strong electromagnetic pulse that travels at the speed of light across the reservoir. As this electromagnetic pulse transits the reservoir, it induces a coupled acoustic vibration at very high frequencies in geologic materials like quartz that causes stimulation at multiple scales in the reservoir body. This induced acoustic vibration acts for a short period of time after the pulse is discharged, usually on the order of about 0.1 to 0.3 seconds, but is induced everywhere that the electromagnetic pulse travels. Thus, it is not limited by the natural acoustic attenuation that limits the effectiveness of a direct acoustic pulse source because it is induced at all locations in-situ by the electromagnetic pulse. At the same time, the lower-frequency direct acoustic pulse travels through the reservoir at the velocity of sound. This direct acoustic pulse assists the electromagnetically-induced vibrations in stimulating the reservoir, but has a clearly limited range due to the finite speed that it can travel before the EM-induced vibrations decay and become ineffective.

Effective acoustic stimulation of oil-bearing reservoirs requires higher frequencies than direct acoustic methods can generate and support at great distances from the stimulation source. Every rock formation can be modeled as a uniform equivalent medium with imbedded inclusions. These inclusions can be present at the pore scale, grain scale, crack scale, lamina scale, bedding scale, sand body scale, and larger scales. Each of these inclusions, or features, of the formation act as scatterers that absorb acoustic energy. The frequency of the energy absorbed is directly correlated to the scale of the inclusions and the contrast in physical properties between the inclusion and the surrounding matrix, and this absorption provides the energy for enhanced oil recovery that is required at a specific scale of inclusion. Hence, an effective acoustic stimulation program can be designed to optimize the energy absorption and effective stimulation if the scale of the inclusions and their physical properties are known, and if the acoustic stimulation frequencies can be targeted at these inclusion scales over a large volume of the reservoir. The limitations and variations in the effectiveness of existing acoustic methods are directly correlated to the narrow band of seismic frequencies from 10–500 hertz used to stimulate and whether there are inclusions at those frequencies within the effective range of the stimulation method in question. When this physical understanding of the role of acoustic absorption by scale dependent features in reservoirs is included, it becomes readily apparent why existing acoustic methods with a frequency band limited to a few hundred hertz are not capable of stimulating most reservoirs effectively. The existing technology has demonstrated a spotty record because the narrow band of frequencies used are often not the right ones for stimulating the critical inclusions of a particular reservoir. The scale of the inclusions that are critical to effective stimulation exist at the pore scale, grain scale, flat-crack scale, and fracture scale, all of which are activated by much higher frequencies (kilohertz and higher) than the band pass of the low-frequency direct acoustic wave.

The present invention differs from all of the prior art in several ways. First, it uses a coupled process of direct EH acoustic vibrations that propagate outward into the formation from one or more wells, and electromagnetically-induced high-frequency acoustic vibrations that are generated using both EH and EM pulsed power discharge devices that takes advantage of the acoustic coupling between the electromagnetic pulse and the formation. This is significantly different from the prior art which relies on acoustic vibrations only, or a combination of acoustic vibrations and low-frequency AC or DC electrical stimulation.

The present invention also recognizes that these two effects must occur together to effectively mobilize the oil and increase production of the oil. The problem that arises is that the EM-induced vibrations only occur for a short time after the electrohydraulic or electromagnetic pulse is initiated. The electrohydraulic acoustic pulse travels at a finite speed from the well where the pulse originates, so that the effective range of the technique is defined by how far the acoustic wave can travel before the electromagnetically-induced vibration in the reservoir ceases. Hence, a single pulse source has a range that is limited by the pulse characteristics employed.

In a preferred embodiment of the present invention, the technique can be applied using a multi-level discharge device that allows sequential firing of several sources in one well in a time sequence that is optimized to allow continuous electromagnetic-coupled stimulation of a large reservoir volume while the electrohydraulic acoustic pulse travels further from the pulse well than it could before a single source electromagnetic vibration would decay. This approach can be used to extend the effective range of the stimulation by a factor of 5–6 from about 1000 feet as claimed and proven in the Wesley patent, i.e., up to distances of 5000 to 6000 feet claimed in the present invention. This allows the technique to be applied effectively to a wide range of oil fields around the world. This concept can be extended to the placement of multiple tools in multiple wells to achieve better stimulation of a specific volume of the reservoir.

In another embodiment of the invention, the range of the technique is extended by using multiple pulse sources in multiple wells that allow the electromagnetically-induced vibrations to continue for a longer time, thus allowing the acoustic pulse to travel further into the formation, effectively extending the range of coupled stimulation that can be achieved. This embodiment utilizes a time-sequential discharge pattern that produces a series of electromagnetically-induced vibrations that will last up to several seconds while the direct acoustic pulse travels further from the discharge source to interact with the electromagnetically-induced vibrations at much greater distances in the reservoir.

In another embodiment of the present invention, multiple EH and EM sources can be placed in multiple wellbores and discharged to act as an array that will stimulate production of the oil in a given direction or specific volume of the reservoir.

In another aspect of the invention, the discharge characteristics of the pulse sources can be customized to produce specific frequencies that will achieve optimal stimulation by activating specific scales of inclusions in the reservoir. In this embodiment, the discharge devices can have their inductances modified to achieve a variety of pulse durations and peak frequencies that are tuned to the specific reservoir properties. This allows for the design of a multi-spectral stimulation program that can activate those inclusions that are critical to enhanced production, while preventing activation of those inclusions that might inhibit enhanced production. Once the desired inclusions for stimulation are defined by conventional geophysical logging methods, a reservoir model is constructed and the optimal frequencies for the stimulation are determined. The pulse tool can be adapted to a wide range of pulse durations and peak frequencies by adjusting the induction of the capacitor circuits in the pulse tool. Where multiple frequencies are desired to achieve stimulation at several scales, the multi-level tool in a single well or multiple tools placed in multiple wells can be tuned to the reservoir to optimize the desired stimulation effect and produce a multi-spectral stimulation of the reservoir.

The present invention also differs from the previous art in that it includes the use of EM pulse sources that do not generate a direct acoustic shock pulse like the plasma shock effect caused by the spark gap in the electrohydraulic device defined by Wesley. These pulse sources replace the conventional spark gap discharge device defined by Wesley with a single-turn magnetic coil that produces a magnetic pulse with no acoustic pulse effect. This tool can be placed in more sensitive wells that will not tolerate the strong shock effect of an EH pulse generator. They also allow a wider range of discharge pulse durations that will extend the effective frequency range of induced vibrations that can be applied to a given reservoir.

In another embodiment of the present invention, the EH pulse source can be directed using a range of directional focusing and shaping devices that will cause the acoustic pulse to travel only in specific directions. This reflector cone allows the operator to aim the pulses from one or multiple wells so that they can effect the specific portion of the formation where stimulation is desired.

In another embodiment of the present invention, the pulse source is placed in an injector well that is being used for water injection, surfactant injection, diluent injection, or CO2 injection. The tool can be configured to operate in a rubber sleeve to isolate it, where appropriate, from the fluids being injected. The tool can be deployed in a packer assembly suspended by production tubing, and can be bathed continuously in water to maintain good coupling to the formation. Gases generated by the electrohydraulic discharge can be removed from the packer assembly by pumping water down the well and allowing the gases to be flushed back up the production tubing to maintain optimal coupling and avoid the increase in compressibility that would occur if the gases were left in the well near the discharge device.

A chronic problem with electrohydraulic discharge devices is that the electrodes are prone to wear and must be replaced from time to time. In another embodiment of the present invention, the electrodes designed for electrohydraulic stimulation have been improved using several methods including (1) improved alloys that withstand the pulse discharge better and last longer, (2) two new feeding devices for exploding filaments, one with a hollow electrode using a pencil filament, and one with a rolled filament on a spool, that allows the exploding filament to be threaded across the spark gap rapidly between discharges so that the pulse generator can operate more efficiently, and (3) gas injection through a hollow electrode that acts as a spark initiation channel.

In another embodiment of the invention, the fluids produced from the wellbore are separated into its components. These components may include one or more of associated gas, condensate, liquid hydrocarbons, helium and other noble gases, carbon dioxide, sulphur dioxide, pyrite, paraffins, heavy metals such as chromium, manganese and vanadium.

DETAILED DESCRIPTION OF THE INVENTION

Figure 1:
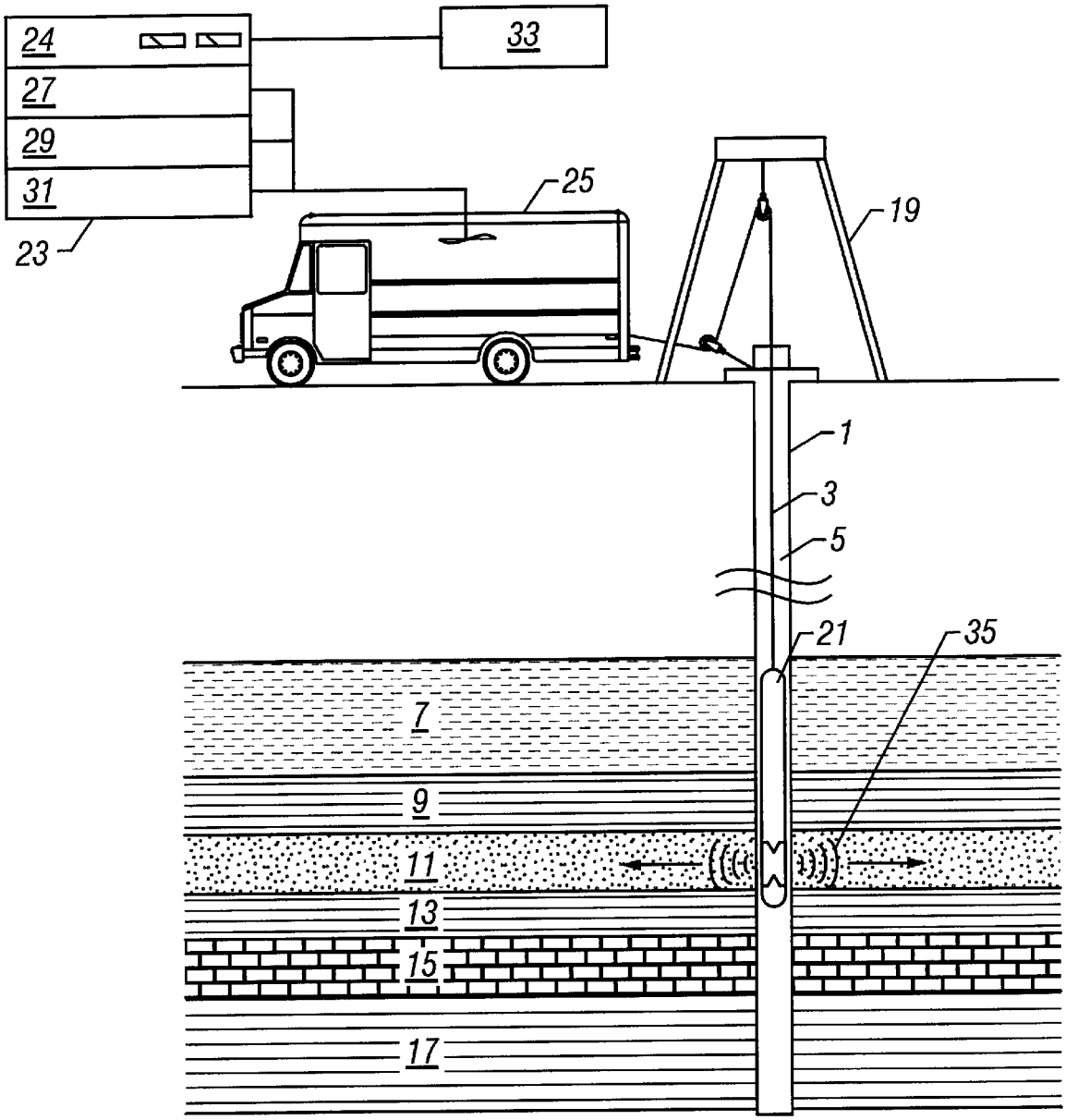
FIG. 1 is a diagram of the basic configuration of the tool as deployed in a wellbore, including the surface equipment, winch truck and control panel, and showing the activation of various scales of the reservoir in a blow-up insert to the diagram.

FIG. 1 shows a wellbore 1 drilled in the subsurface of the earth penetrating formations 7, 9, 11, 13. 15 . . . The wellbore 1 is typically filled with a drilling fluid 5 known in the art as "drilling mud.". The sonde 21 that forms part of the present invention is conveyed downhole, in the preferred embodiment of the present invention, on an armored electrical cable, commonly called a wireline 3.

The wireline is supported by a derrick 19 or other suitable device and may be spooled onto a drum (not shown) on a truck 25. By suitable rotation of the drum, the downhole tool may be lowered to any desired depth in the borehole. In FIG. 1, for illustrative purposes, the downhole tool is shown as being at the depth of the formation 11. This is commonly a hydrocarbon reservoir from which recovery of hydrocarbons is desired. An uphole power source 33 and a surface control unit 23 provide electrical power and control signals through the electrical conductors in the wireline to the sonde 21. In FIG. 1, the sonde is depicted as generating energy pulses 35 into one of the subsurface formations.

The control unit 23 includes a power control unit 25 that controls the supply of power to the sonde 21. The surface control unit also includes a fire control unit 27 that is used to initiate generation of the energy pulses 35 by the sonde. Another component of the surface control unit 23 is the inductance control unit 29 that controls the pulse duration of the energy pulses 35. Yet another component of the surface control unit is the rotation control 31 that is used to control the orientation of components of the sonde 35. The functions of the power control unit 25, the fire control unit 27, the inductance control unit 29 and the rotation control unit 31 are discussed below in reference to FIG. 3.

Figure 2:
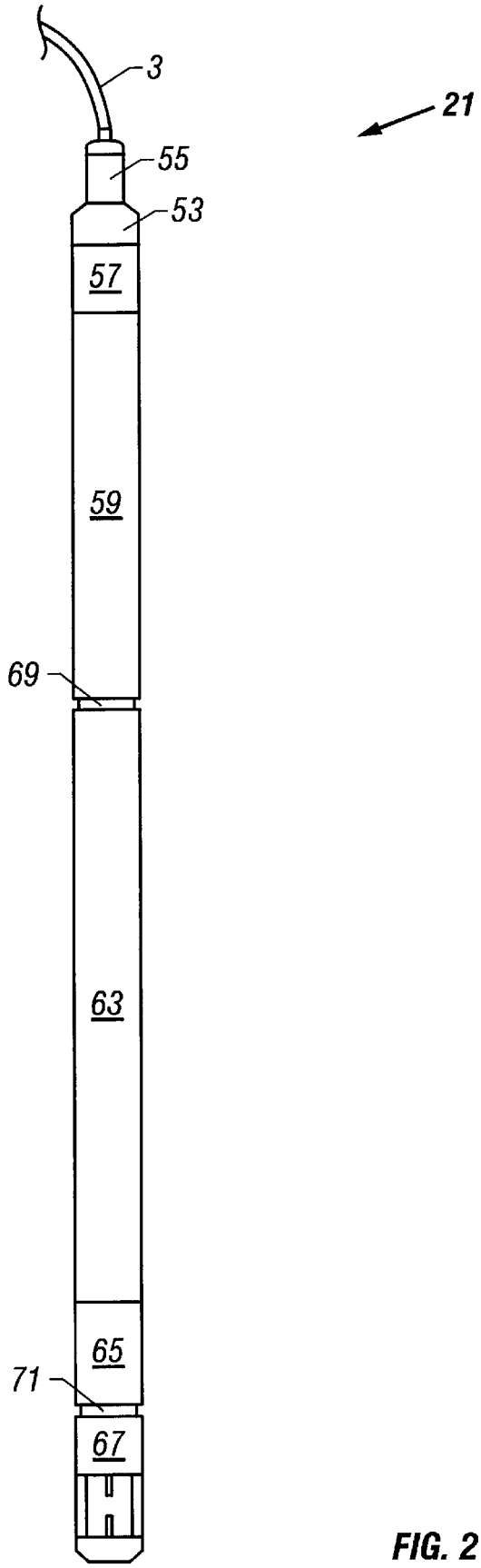
FIG. 2 is a diagram showing improvements in the basic one-level tool from U.S. Pat. No. 4,345,650 of Wesley.

One embodiment of the invention is a tool designed for operation at a single level in a borehole. This is illustrated in FIG. 2 that is a view of the sonde 21 land the major components thereof as adapted to be lowered into the well. The basic EH sonde is an improvement over that disclosed in U.S. Pat. No. 4,345,650 issued to Wesley and the contents of which are fully incorporated here by reference.

One set of modifications relates to the use of processors wherever possible, instead of the electronic circuitry. This includes the surface control unit 23 and its components as well as in the downhole sonde.

In a preferred embodiment of the invention, the sonde 21 is used within a cased well, though it is to be understood that the present invention may also be used in an uncased well. The sonde 21 comprises an adapter 53 that is supported by a cable head adapter 55 for electrical connection to the electrical conductors of the wireline 3. The sonde 21 includes a gyro section 57 that is used for establishing the orientation of the sonde and may additionally provide depth information to supplement any depth information obtained uphole in the truck 25 based upon rotation of the take-up spool. The operation of the gyro section 57 would be known to those versed in the art and is not discussed further. The gyro section 57 here is an improvement over the Wesley device and makes it possible to controllably produce energy pulses in selected directions.

The other main components of the sonde 21 are a power conversion and conditioning system 59, a power storage section 63, a discharge and inductance control section 65, and the discharge section 67. A connector 69 couples the power conversion and conditioning section to the power storage section 63. The power storage section 63, as discussed in the Wesley patent, comprises a bank of capacitors for storage of electrical energy. Electrical power is supplied at a steady and relatively low power from the surface through the wireline 3 to the sonde and the power conversion and conditioning system includes suitable circuitry for charging of the capacitors in the power storage section 63. Timing of the discharge of the energy in the power from the power storage section 63 through the discharge section 67 is accomplished using the discharge and induction control section 65 on the basis of a signal from the fire control unit (27 in FIG. 1). Upon discharge of the capacitors in the power storage section 63 through the discharge section 67 energy pulses are transmitted into the formation. In one embodiment of the invention, the discharge section 67 produces EH pulses. Refinements in the design of the discharge section 67 over that disclosed in the Wesley patent are discussed below with reference to FIGS. 9–12.

Figure 3:
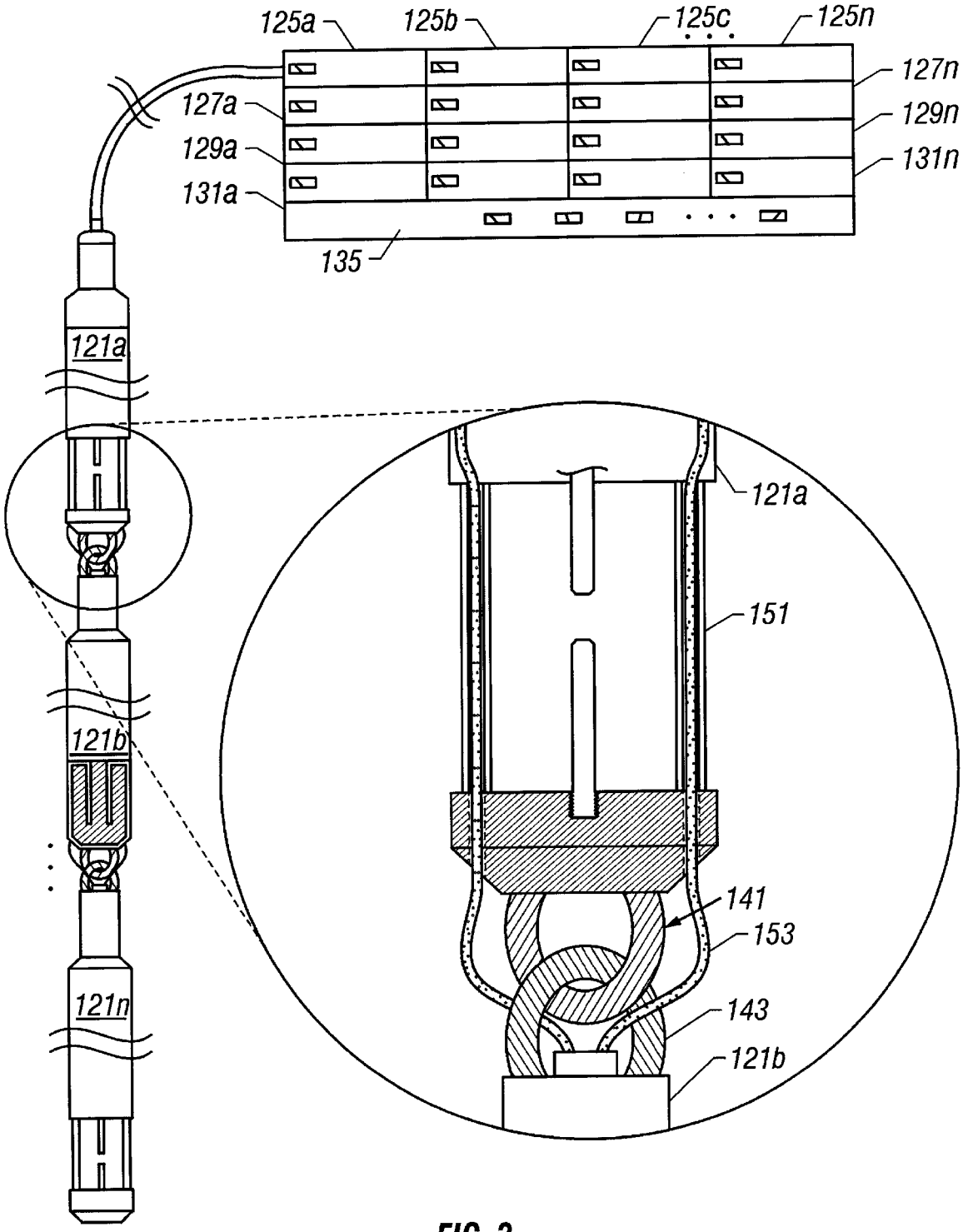
FIG. 3 is a diagram showing the design of a multi-level tool allowing time sequential and variable inductance discharges with both EH and EM discharge devices under user control.

Turning now to FIG. 3, an embodiment of the invention suitable for use with multiple levels of energy stimulation into the formation is illustrated. The downhole portion of the apparatus comprises a plurality of sondes 121*a*, 121*b*, . . . 121*n*. For illustrative purposes, only three sondes are shown. The coupling between two of the sondes 121*a* and 121*b* is illustrated in detail in the figure. Eyehooks 141 and 143 enable sonde 121*b* to be suspended below sonde 121*a*. This eyehook arrangement allows for a limited rotation of sonde 121*b* relative to sonde 121*a*. Flexible electrical leads 153 carry power and signals to the lower sonde 121*b* and the eyehooks ensure that the leads 153 are not subjected to stresses that might cause them to break. The leads are carried within support post 151 in the upper sonde 121*a*. A similar arrangement is used for suspending the remaining sondes.

Each of the sondes 121*a*, 121*b* . . . 121*n* has corresponding components in the surface control unit 123. Illustrated are power control units 125*a*, 125*b* . . . 125*n* for power supply to the sondes; inductance control units 127*a*, 127*b* . . . 127*n* for inductance control; rotation control units 129*a*, 129*b* . . . 129*n* for controlling the rotation of the various sondes relative to each other about the longitudinal axes of the sondes (see rotation bearing 71 in FIG. 2); and inclination control unites 131*a*, 131*b*, . . . 131*n* for controlling the inclination of the discharge sections (see 67 in FIG. 2) of the sondes relative to the horizontal. In addition, the surface control unit also includes a fire control and synchronization unit 135 that controls the sequence in which the different sondes 121*a*, 121*b*, . . . 121*n* are discharged to send energy into the subsurface formations.

Figure 4:
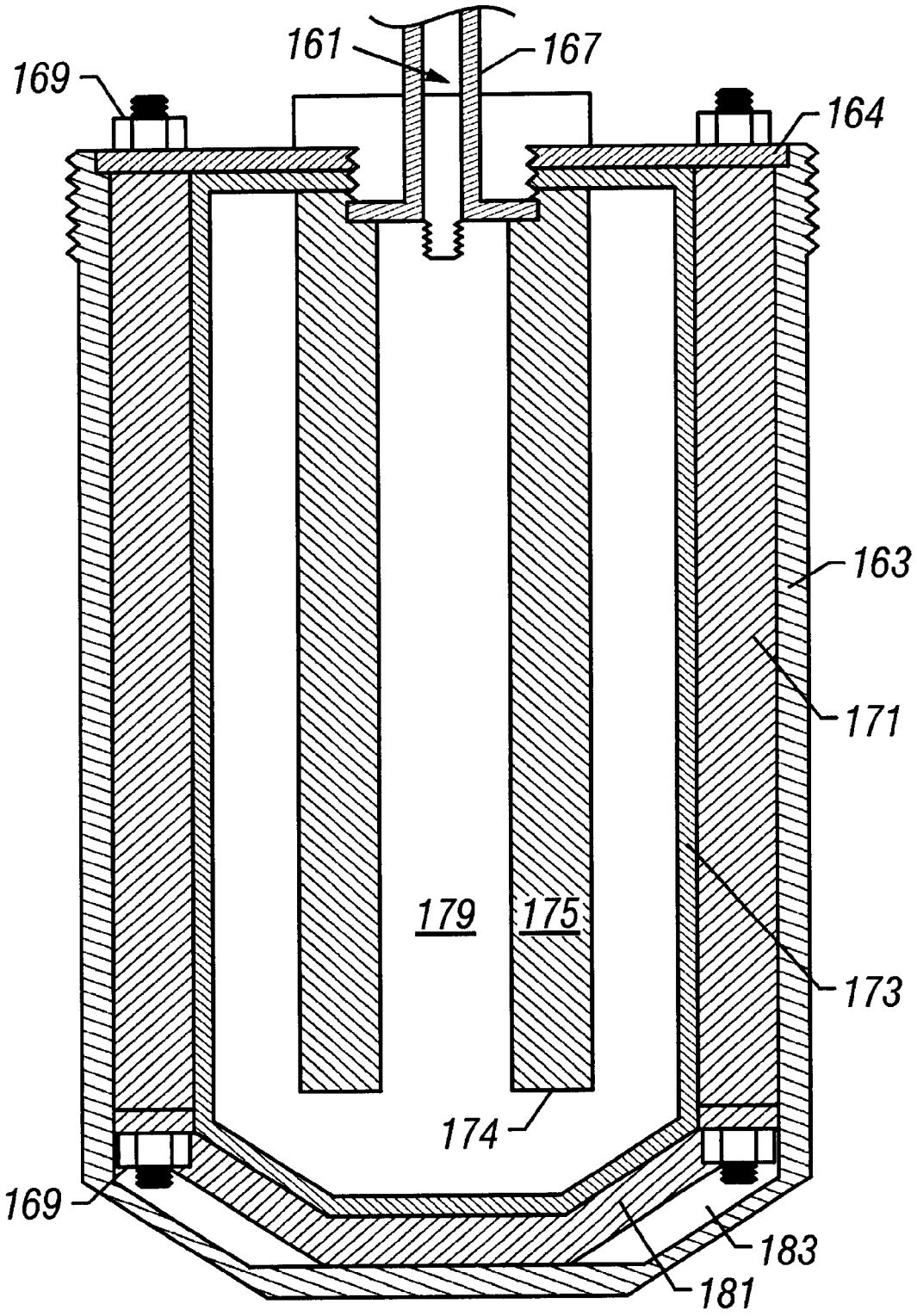
FIG. 4 is a schematic diagram showing the design of a single-turn coil EM discharge device for the tool with rubber sleeve for electrical isolation.

Turning next to FIG. 4, an EM pulse source is depicted. This is a single-turn magnetic coil that produces a magnetic pulse with no significant acoustic pulse. This tool can be placed in more sensitive wells that will not tolerate the strong shock effect of an EH pulse generator. It also allows a wider range of discharge pulse durations that will extend the effective frequency range of induced vibrations (up to 100 microseconds) that can be applied to a given reservoir.

The input electrical power is supplied by a conductor 161. The EM discharge device comprises a cylindrical single-turn electromagnet 179 having an annular cavity 174 filled with insulation 175. The electromagnet body is separated by rubber insulation 173 from the steel top plate 164 and the steel base plate 181. Steel support rods 171 couple the steel top plate 164 and the steel base plate 181. The whole is within a nonconductive housing 163 with an expansion gap between the steel base plate 183. Optionally, provision may be made for circulating a cooling liquid between the electromagnet body 179 and the rubber insulation 173. The electromagnet does not allow current to flow back out of the device, which results in dissipative resistive heating of the magnet from each pulse, hence the potential need for a cooling medium if rapid discharge is desired.

Figure 5:
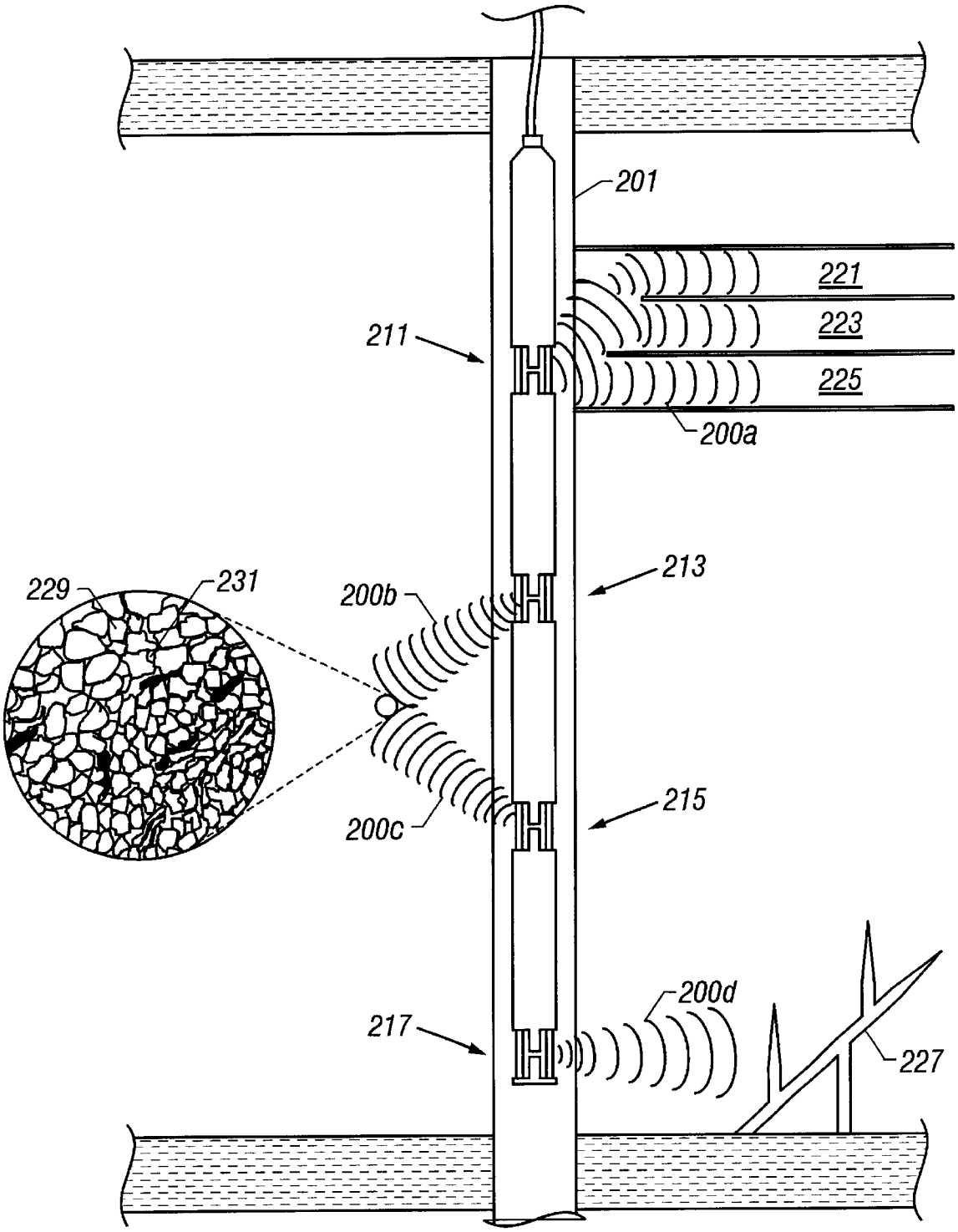
FIG. 5 is a schematic diagram showing the activation of a reservoir adjacent to the tool with a multi-level discharge device.

Turning next to FIG. 5, the different scales at which the flow of reservoir fluids in the subsurface is depicted. Depicted schematically are four energy sources 211, 213, 215 and 217 within a borehole 201. Waves 200*a* from source 211 are depicted as propagating into formations 221, 223 and 225 to stimulate the flow of hydrocarbons therein. The frequency of these waves is selected to stimulate flow on the scale of bedding layers: typically, this is of the order of a few centimeters to a few meters.

The energy source 217 is shown propagating waves 200*d* into the subsurface to stimulate flow of hydrocarbons from fractures 227 therein. As would be known to those versed in the art, these fractures may range in size from a few millimeters to a few centimeters. Accordingly, the frequency associated with the waves 200*d* would be greater than the frequency associated with the waves 200*a*.

Also shown in FIG. 5 are waves 200*b* and 200*c* from sources 213 and 215 are depicted as propagating into the formation to stimulate flow of hydrocarbons on the scale of grain size 229 and pore size 231. Typical grain sizes for subsurface formations range from 0.1 mm to 2 mm. while pore sizes may range from 0.01 mm to about 0.5 mm, so that the frequency for stimulation of hydrocarbons at the grain size scale is higher than for the fractures and the frequency for stimulation of flow at the pore size level is higher still.

As would be known to those versed in the art, the discharge of a capacitor is basically determined by the inductance and resistance of the discharge path. Accordingly, one function of the inductance control units (27 in FIG. 1; 65 in FIG. 2; 127*a* . . . 127*n* in FIG. 3) in the invention is to adjust the rate of discharge (the pulse duration) and the frequency of oscillations associated with the discharge.

Figure 6A:
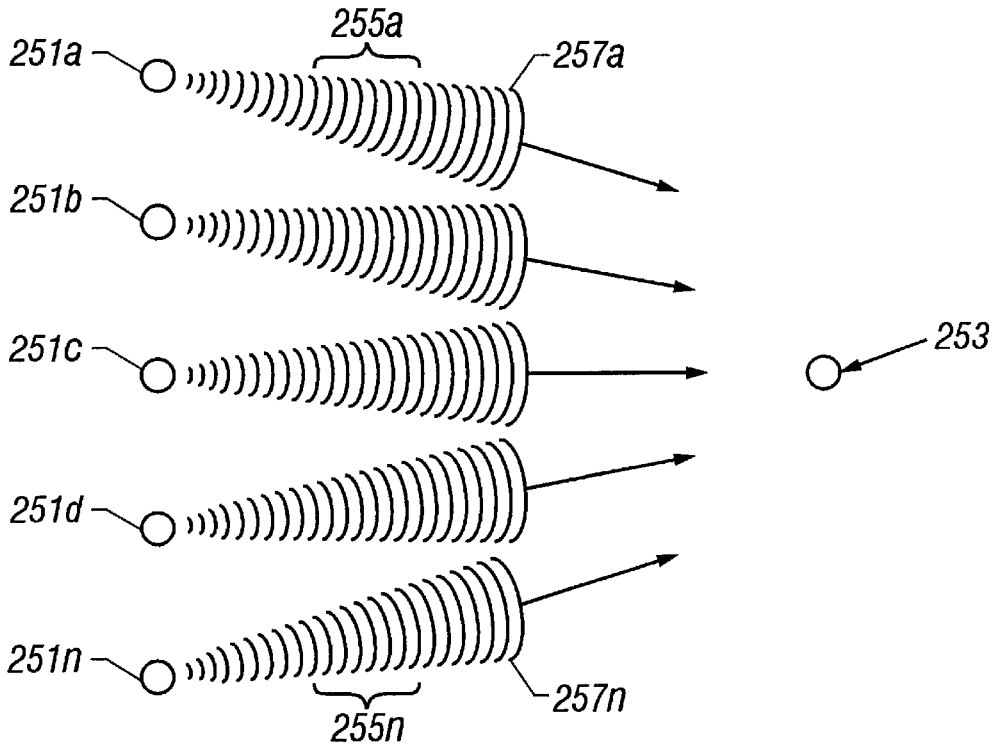
FIG. 6 is a schematic diagram showing the deployment of multiple tools in multiple wells to act as a source array.

FIG. 6*a* is a plan view of an arrangement of wells using the present invention. Shown is a producing well 253 and a number of injection wells 251*a*, 251*b*, 251*c* . . . 251*n*. Each of the wells includes a source of EH or EM energy. Shown in FIG. 6*a* are the acoustic waves 255*a*, 255*b* . . . 255*n* propagating from the injection wells in the formation towards the producing well. When sources in all the injection wells 251*a*, 251*b*, 251*c* . . . 251*n* are discharged simultaneously, then the acoustic wavefronts, depicted here by 257*a* . . . 257*n* propagate through the subsurface as shown and arrive at the producing well substantially simultaneously, so that the stimulation of hydrocarbon production by the different sources occurs substantially simultaneously.

One or more of the wells 251*a*, 251*b*, 251*c* . . . 251*n* may be used for water injection, surfactant injection, diluent injection, or CO2 injection using known methods. The tool can be configured to operate in a rubber sleeve to isolate it, where appropriate, from the fluids being injected. The tool can be deployed in a packer assembly suspended by production tubing, and can be bathed continuously in water to maintain good coupling to the formation. Gases generated by the electrohydraulic discharge can be removed from the packer assembly by pumping water down the well and allowing the gases to be flushed back up the production tubing to maintain optimal coupling and avoid the increase in compressibility that would occur if the gases were left in the well near the discharge device. This is discussed below with reference to FIGS. 7 and 8.

Figure 6B:
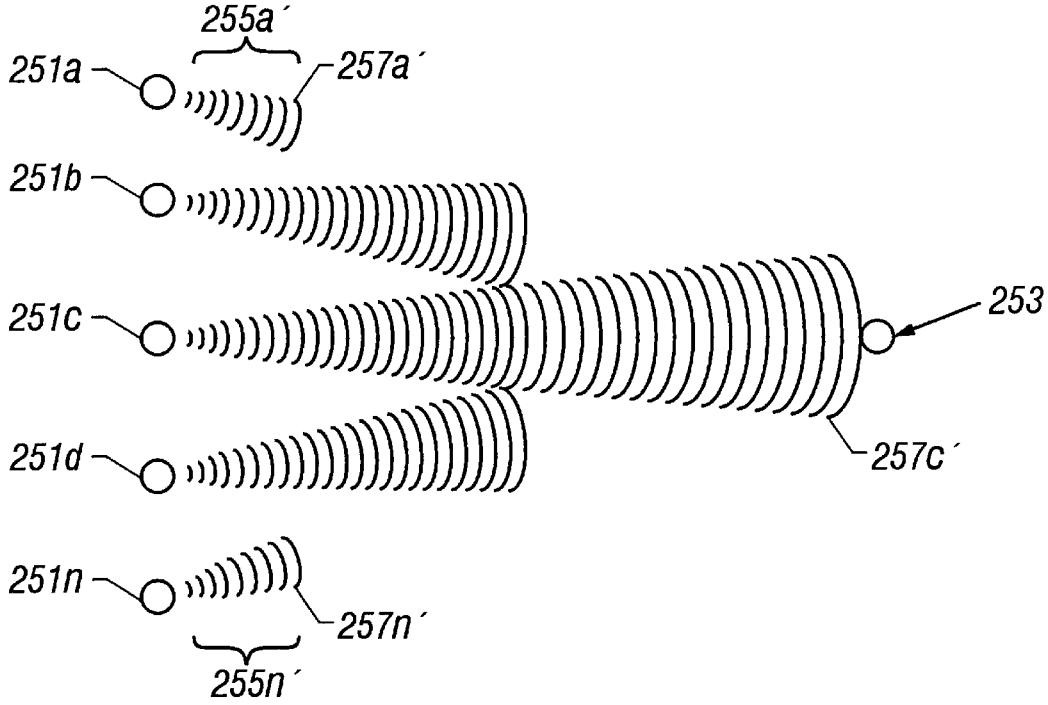

FIG. 6*b* shows a similar arrangement of injection wells 251*a*, 251*b* . . . 251*n* and a producing well 253. However, if the sources in the injection well are excited at different times by the surface control unit, then the acoustic waves 255*a*′, . . . 255*n*′ appear as shown and the corresponding wavefronts 257*a*′, . . . 257*n*′ arrive at the producing well at different times. In the example shown in FIG. 6*b*, the acoustic wave 257*c*′ from well 251*c* is the first to arrive.

In both FIG. 6*a* and 6*b*, the injection wells have been shown more or less linearly arranged on one side of the producing well. This is for illustrative purposes only and in actual practice, the injection wells may be arranged in any manner with respect to the producing well. Those versed in the art would recognize that with the arrangement of either 6*a* or 6*b*, the frequencies of the acoustic pulses may be controlled to a limited extent by controlling the pulse discharge in the sources using the inductance controls of the surface control unit. As noted in the background to the invention, these acoustic waves will have a limited range of frequencies. However, when combined with the large range of frequencies possible with the EM waves, the production of hydrocarbons may be significantly improved over prior art methods.

Figure 7:
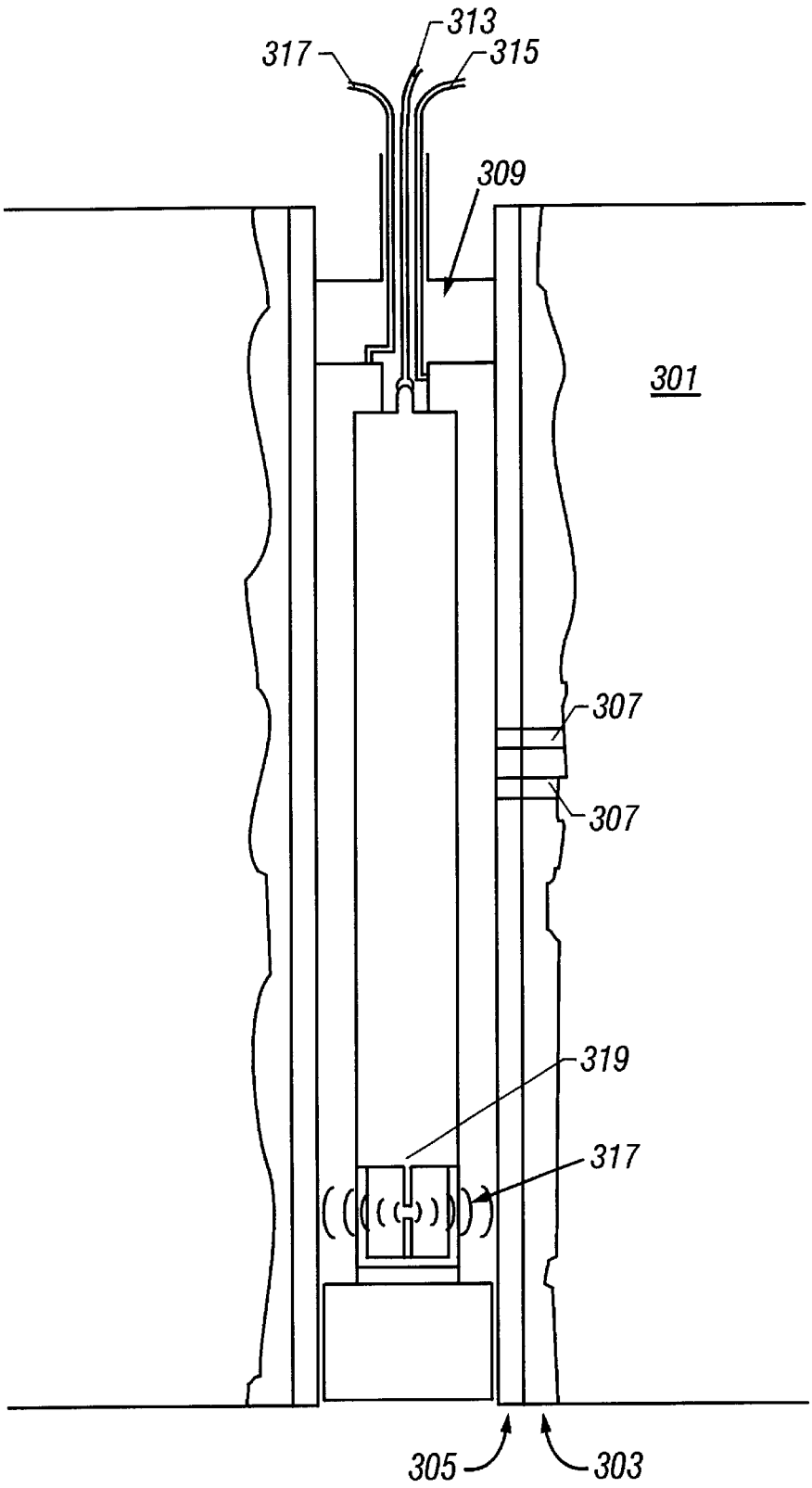
FIG. 7 is a schematic diagram showing the deployment of a tool contained in a packer assembly in an injector well with tubing to feed water and electrical and control leads.

Turning now to FIG. 7, a tool of the present invention is shown deployed in a cased borehole within a formation 301. The casing 305 and the cement 303 have perforations 307 therein. An upper packer assembly 309 and a lower packer assembly 311 serve to isolate the source and limit the depth interval of the well over which energy pulses are injected into the formation. In addition to the power supply 313, provision is also made for water inflow 315 and water outflow 317. The outflow carries with it any gases generated by the excitation of the source 319. With the provision of the water supply, the borehole between the packers 309, 311 is filled with water or other suitable fluid and is in good acoustic coupling with the formation. This increases the efficiency of generation of acoustic pulses into the formation.

Figure 8:
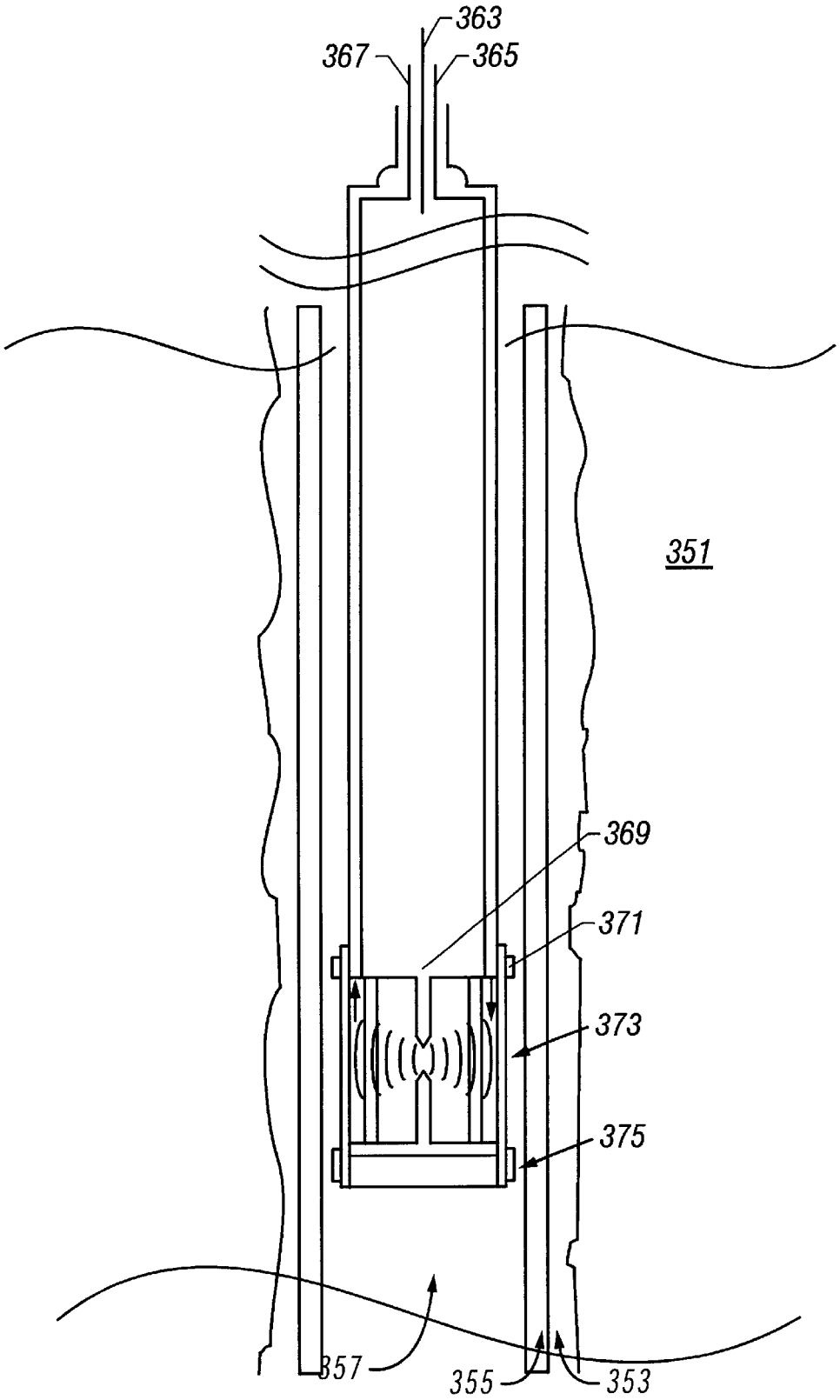
FIG. 8 is a schematic diagram showing the design of the tool incorporating a sleeve exploder configuration for non-packer applications.

An alternate embodiment of the invention that does not use packer assemblies is schematically depicted in FIG. 8 wherein a tool of the present invention is shown deployed in a cased borehole within a formation 351. The casing 355 and the cement 353 have perforations (not shown). As in the embodiment of FIG. 7, in addition to the power supply 363, provision is also made for water inflow 365 and water outflow 367. The outflow carries with it any gases generated by the excitation of the source 369. The tool is provided with a flexible sleeve 373 that is clamped to the body of the tool by clamps 371 and 375. The sleeve isolates the fluid filled wellbore 357 from the water and the explosive source within the sleeve while maintaining acoustic coupling with the formation.

Figure 9:
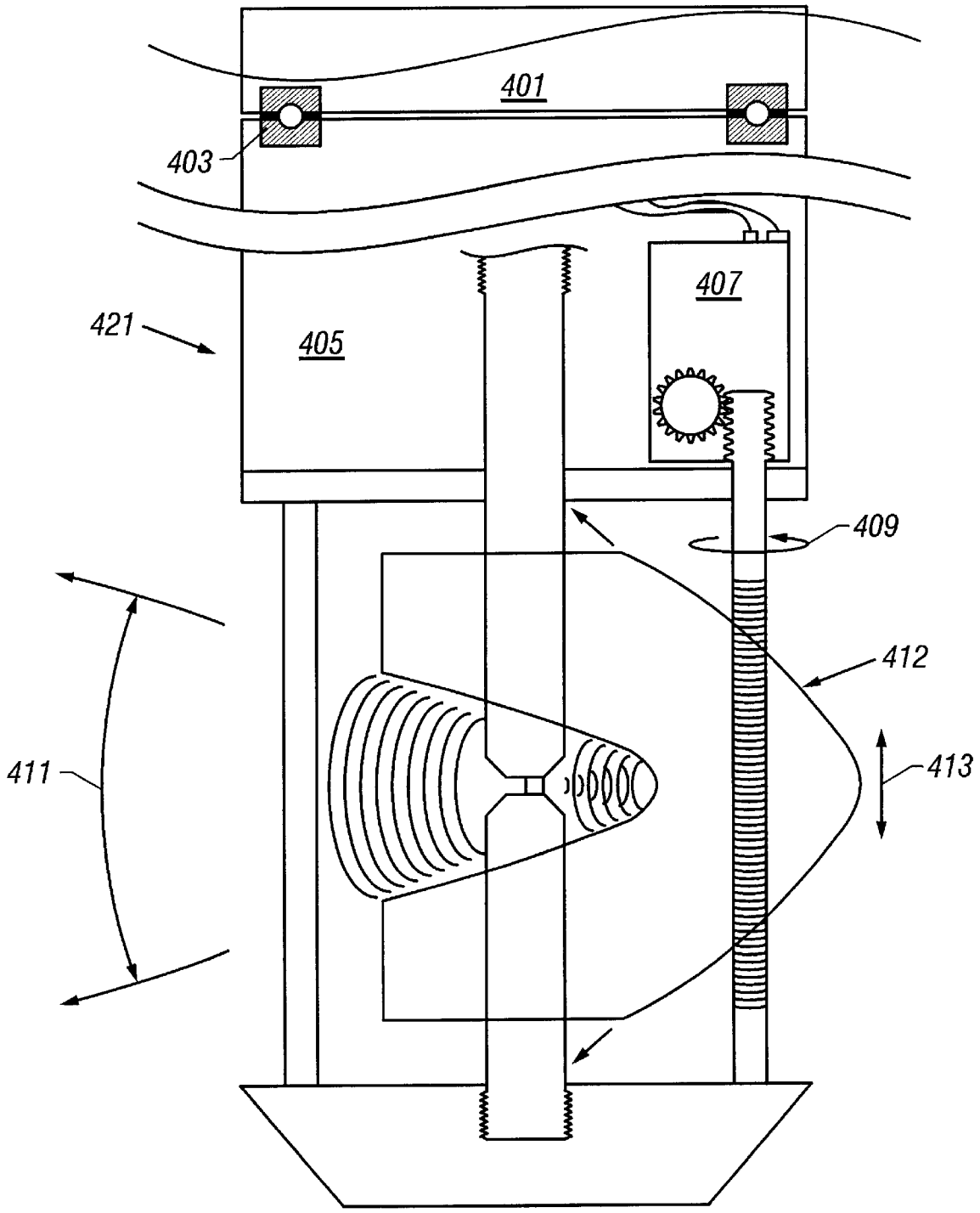
FIG. 9 is a schematic diagram showing the design of the directional energy cone for the EH discharge device.

Turning now to FIG. 9, an embodiment of the invention allowing for directional control of the outgoing energy is illustrated. The tool 421 includes a bearing 403 that allows for rotation of the lower portion 405 relative to the upper portion 401. This rotation is accomplished by a motor (not shown) that is controlled from the surface control unit. By this mechanism, the energy may be directed towards any azimuth desired. In addition, the tool includes a controller motor that rotates a threaded rotating post 409. Rotation of the post 409 pivots a pulse director 412 in a vertical plane, and a substantially cone-shaped opening in the pulse director directs the outgoing energy in the vertical direction.

Figure 10:
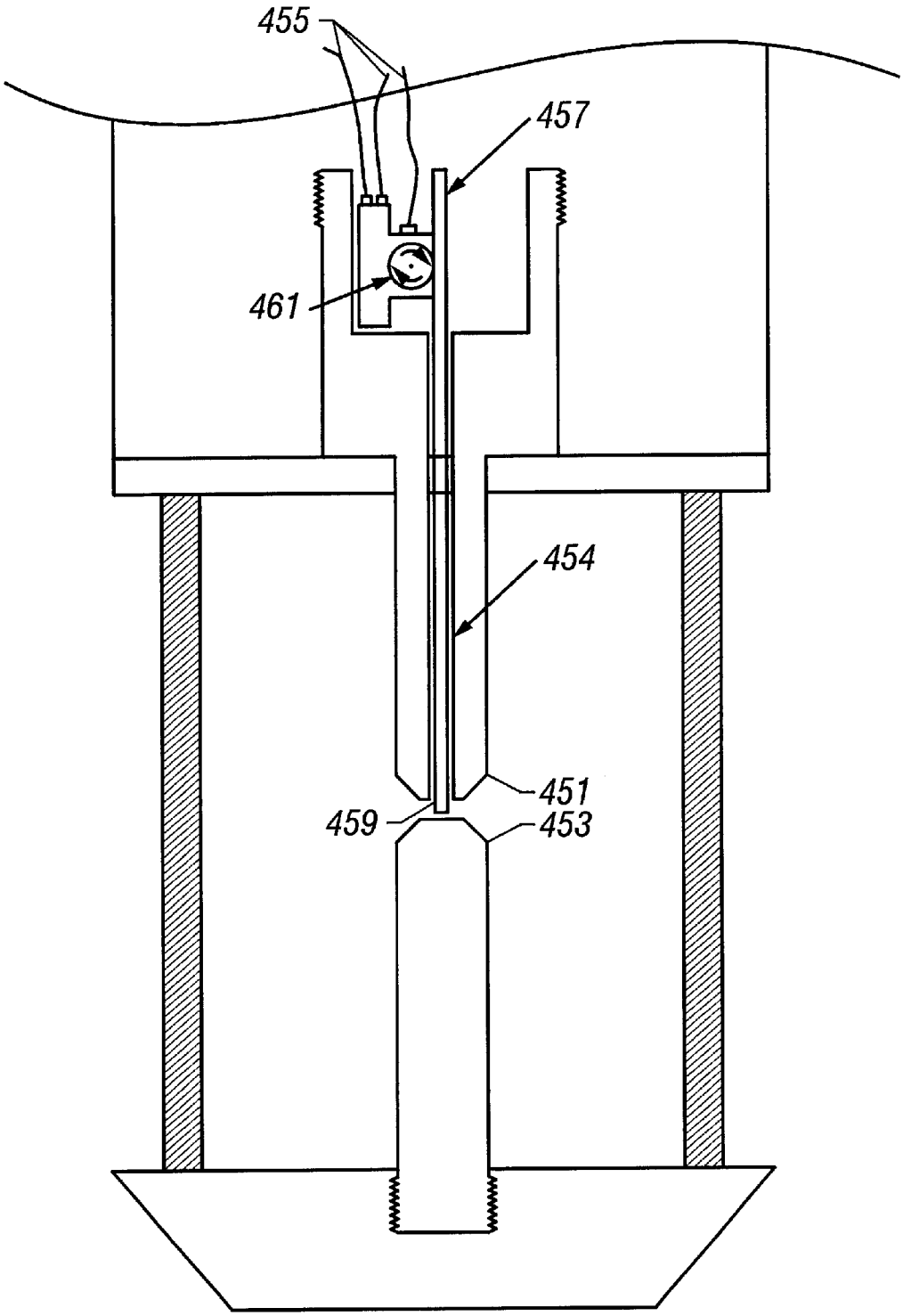
FIG. 10 is a schematic diagram showing the design of hollow EH electrodes with a pencil exploding filament device.

A common problem with prior art spark discharge devices is damage to the electrodes from repeated firing. One embodiment of the present invention that addresses this problem is depicted in FIG. 10. Shown are the electrodes 451 and 453 between which an electrical discharge is produced by the discharge of the capacitors discussed above with reference to FIG. 2. The electrode 451 connected to the power supply (not shown) is referred to as the "live" electrode. In such spark discharge devices, the greatest amount of damage occurs to the live electrode upon initiation of the spark discharge. In the device shown in FIG. 10, the live electrode is provided with a hollow cavity 454 through which a pencil electrode 457 passes. The pencil electrode 457 is designed to be expendable and initiation of the spark discharge occurs from the pencil electrode while the bulk of the electrical discharge occurs from the live electrode 451 after the spark discharge is initiated. This greatly reduces damage to the live electrode 451 with most of the damage being limited to the end 459 of the pencil electrode from which the spark discharge is initiated. The device is provided with a motor drive 455 that feeds the pencil electrode 457 through the live electrode upon receipt of a signal from the control unit received through the power and control leads 455. In one embodiment of the invention, this signal is provided after a predetermined number of discharges. Alternatively, a sensor (not shown) in the downhole device measures wear on the pencil electrode and sends a signal to the control unit.

Figure 11:
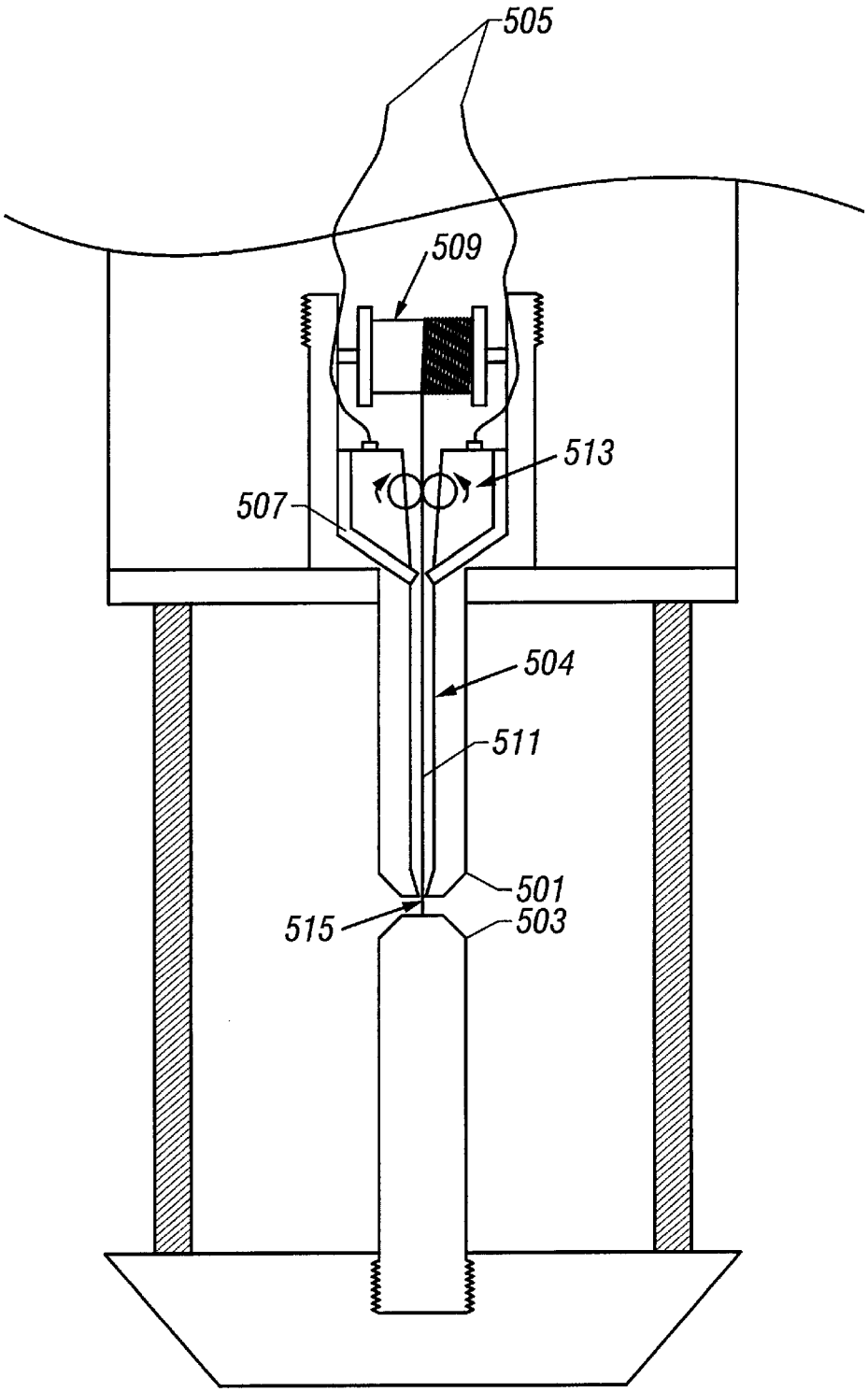
FIG. 11 is a schematic diagram showing the design of hollow EH electrodes with a spooled feeding device for an exploding filament.

Another embodiment of the invention illustrated schematically in FIG. 11 uses a filament for the initiation of the spark discharge. The power leads (not shown) are connected to the live electrode 501 as before, and the return electrode 503 is positioned in the same way as before. The filament 511 is wound on a spool 509 and is carried between rollers 513 into a hole 504 within the live electrode. The spark is initiated at the tip 515 of the filament 511. The filament 511 gets consumed by successive spark discharges and additional lengths are unwound from the spool 509 as needed using the power and control leads 505.

Figure 12:
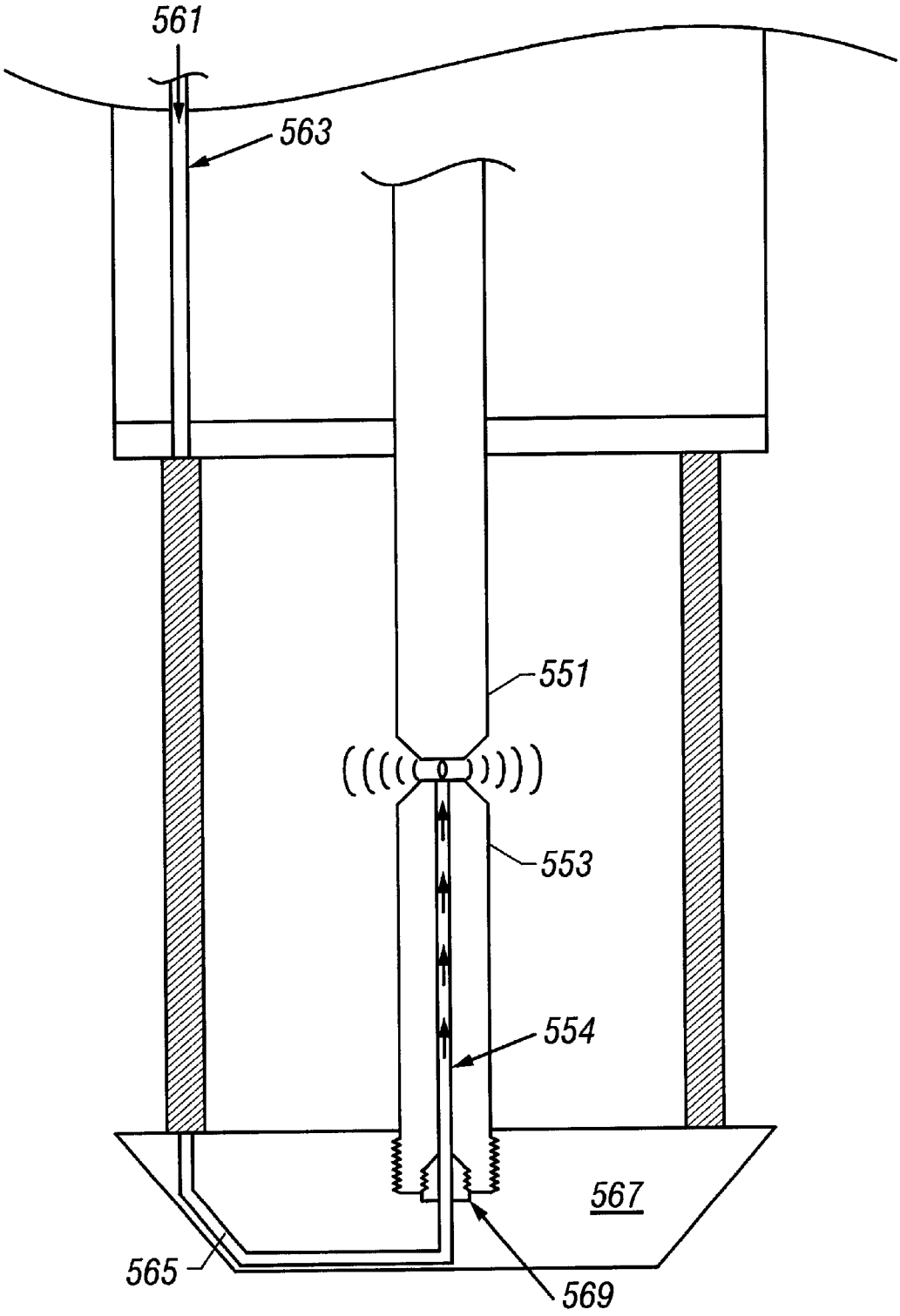
FIG. 12 is a schematic diagram showing the design of hollow electrodes with a gas-injection device for improving electrode wear.

FIG. 12 shows another embodiment of the invention wherein a gas 561 is conveyed through tubes 563 and 565 to the hollow lower electrode 553 via a threaded pressure fitting 569. The lower electrode is coupled by means of a thread to the bottom plate 567. The flowing gas gets ionized by the potential difference between the lower electrode 553 and the upper electrode 551. The initiation of the spark takes place in this ionized gas, thereby reducing damage to the electrodes 551 and 553.

There are a number of different methods in which the various embodiments of the device discussed above may be used. Central to all of them is the initiation of an electromagnetic wave into the formation. The EM wave by itself produces little significant hydrocarbon flow on a macroscopic scale; however, it does serve the function of exciting the hydrocarbons within the formation at a number of different scales as discussed above with reference to FIG. 5. This EM wave may be produced by an electromagnetic device, such as is shown in FIG. 4, or may be produced as part of an EH wave by a device such as described in the Wesley patent or described above with reference to FIGS. 10, 11 or 12. This EM wave is initiated at substantially the same time as the arrival of the acoustic component of an earlier EH wave at the zone of interest from which hydrocarbon recovery is desired. Any suitable combination of EH and EM sources fired at appropriate times may be used for the purpose as long as an EM and an acoustic pulse arrive at the region of interest at substantially the same time.

For example, a single EH source as in FIG. 1, may be fired in a repetitive manner so that acoustic pulses propagate into the layer 11: the EM component of later firings of the EH source will then produce the necessary conditions for stimulation of hydrocarbon flow at increasing distances from the wellbore 1. Also by way of example, a vertical array of sources such as is shown in FIG. 5 may be used to propagate EM and acoustic pulses into the formation to stimulate hydrocarbon flow from different formations and from different types of pore spaces (fractures, intragranular, etc.). EH and/or EM sources may be fired from a plurality of wellbores as shown in FIG. 6*a*, 6*b* to stimulate hydrocarbon flow in the vicinity of a single production well. The sources may be oriented in any predetermined direction in azimuth and elevation using a device as shown in FIG. 9. In any of the arrangements, additional materials such as steam, water, a surfactant, a diluent or $CO_2$ may be injected into the subsurface. The injected material serves to increased the mobility of the hydrocarbon, and/or increase the flow of hydrocarbon.

The primary purpose of using electrohydraulic stimulation as described above is the recovery of hydrocarbons from the subsurface formations. However, as noted above in the Background of the Invention, the fluids recovered from a producing borehole may include a mixture of hydrocarbons and water and additional material such as, solids, $CO_2$, $H_2S$, $SO_2$, inert gases.

H. Vernon Smith in Chapter 12 of the Petroleum Engineering Handbook (Society of Petroleum Engineers), and the contents of which are fully incorporated herein by reference, reviews devices known as Oil and Gas Separators, that are normally used near the wellhead, manifold or tank battery to separate fluids produced from oil and gas wells into oil and gas or liquid and gas. In one embodiment of the present invention, any of the devices discussed in Smith may be used to separate fluids produced by the electrohydraulic stimulation discussed above. Favret (U.S. Pat. No. 3,893,918), the contents of which are fully incorporated herein by reference, teaches a fractionation column for separation of oil from a fluid mixture containing oil. Kjos (U.S. Pat. No. 5,860,476), the contents of which are incorporated herein by reference, teaches an arrangement in which a first cyclone separator is used to separate gas and liquid, a second cyclone separation is used to separate condensate/oil from water, and a membrane separation us used to separate gases including $H_2S$, $CO_2$, and $SO_2$. U.S. Pat. No. 4,805,697 to Fouillout et al, the contents of which are fully incorporated herein by reference, teaches a method in which recovered fluids from the wellbore are separated into an aqueous and a light phase consisting primarily of hydrocarbons and the aqueous phase is reinjected into the producing formation.

U.S. Pat. No. 6,085,549 to Daus et al., the contents of which are fully incorporated herein by reference, teaches a membrane process for separating carbon dioxide from a gas stream. U.S. Pat. No. 4,589,896 to Chen et al, the contents of which are fully incorporated herein by reference, discloses the use of a membrane process for separation of $CO_2$ and $H_2S$ from a sour gas stream. One embodiment of the present invention uses a membrane process such as that taught by Daus and Chen et al to separate $CO_2$, $H_2S$, He, Ar, $N_2$, hydrocarbon vapors and/or $H_2O$ from a gaseous component of the recovered fluids from the borehole: *Perry's Chemical Engineers' Handbook*, $7^{th}$ *Ed.*, by Robert H. Perry and Don W. Green, 1997, Chapter 22, Membrane Separation Processes, page 22–61, Gas-Separation Processes the contents of which are incorporated herein by reference, teaches further methods for accomplishing such separation.

U.S. Pat. No. 5,983,663 to Sterner, the contents of which are fully incorporated herein by reference, discloses a fractionation process for separation of of $CO_2$ and $H_2S$ from a gas stream. One embodiment of the invention uses a fractionation process to separate $CO_2$ and $H_2S$ from the recovered formation fluids.

Another embodiment of the invention uses a solvent method for removing $H_2S$ from the recovered formation fluids using a method such as that taught by Minkkinen et al in U.S. Pat. No. 5,735,936, the contents of which are incorporated herein by reference.

Cryogenic separation may also be used to separate carbon dioxide and other acid gases from the recovered formation fluids. Examples of such methods are disclosed in Swallow (U.S. Pat. No. 4 ,441,900) and in Valencia et al (U.S. Pat. 4,923,493) the contents of which are fully incorporated herein by reference. Those versed in the art would recognize that removal of carbon dioxide from the recovered formation fluids is particularly important if, as discussed above with reference to FIG. 6*a*, $CO_2$ injection is used in conjunction with electrohydraulic stimulation.

Another embodiment of the invention uses a process of cryogenic separation such as that taught by Wissoliki (U.S. Pat. No. 6,131,407), the contents of which are fully incorporated here by reference, for recovering argon, oxygen and nitrogen from a natural gas stream. Optionally, Helium may be recovered from a natural gas stream using a cryogenic separation such as that taught by Blackwell et al (U.S. Pat.

No. 3,599,438), the contents of which are incorporated herein by reference. In another embodiment of the invention, a combination of cryogenic separation and solvent extraction, such as that disclosed in Mehra (U.S. Pat. No. 5,224,350) may be used for recovery of Helium.

As discussed above, a heavy liquid portion of the recovered formation fluids may include vanadium, nickel, sulphur and asphaltenes. In an alternate embodiment of the present invention, these may be recovered by using, for example, the method taught by Uedal et al (U.S. Pat. No. 3,936,371), the contents of which are incorporated herein by reference. The process disclosed in Ueda includes bringing the liquid hydrocarbon in contact with a red mud containing alumina, silica and ferric oxide at elevated temperatures in the presence of hydrogen. Another method for recovery of heavy metals disclosed by Cha et al (U.S. Pat. No. 5,041,209) includes mixing the heavy crude oil with tar sand, heating the mixture to about 800° F. and separating the tar send from the light oils formed during the heating. The heavy metals are then removed from the tar sand by pyrolysis.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A process for recovering a desired constituent of a fluid from at least one porous zone of a subterranean formation, the method comprising:

(a) generating an electrical pulsed discharge in a first borehole at a distance from the at least one porous zone and propagating an electromagnetic wave into the formation at a first time, said electromagnetic wave reaching the at least one porous zone at a time substantially equal to the first time and inducing ultrasonic vibrations within said at least one porous zone;

(b) propagating at a second time an acoustic wave into the formation, said acoustic wave arriving at said at least one porous zone at a time substantially equal to the first time and combining with said ultrasonic vibrations thereby enhancing the mobility of previously immobile fluid in the at least one porous zone;

(c) recovering a fluid including the mobilized fluid from a producing well in the at least one porous zone to give a recovered fluid; and (d) using at least one process selected from gravity separation, fractionation, cyclone separation, membrane separation, solvent extraction, cryogenic separation, liquefaction, and pyrolysis to obtain the desired constituent from the recovered fluid.

2. The method of claim 1 further comprising generating the acoustic wave in the first borehole.

3. The method of claim 2 wherein the electromagnetic wave is produced by a first pulse generator and the acoustic wave is produced by a second pulse generator.

4. The method of claim 3 wherein the first and the second pulse generator each produce electromagnetic and acoustic pulses.

5. The method of claim 4 wherein the first and the second pulse generator are part of an array including a plurality of pulse generators, the method further comprising generating at least one additional electrical pulse for propagating at least one additional electromagnetic wave and acoustic wave, so that the second or later acoustic wave is permitted to reach a greater volume of the reservoir while the first or later electromagnetic wave is still causing induced acoustic vibration in the reservoir.

6. The method of claim 4 wherein the first and the second pulse generator are part of an array including a plurality of pulse generators, the method further comprising generating multiple electrical pulses at the same time, but with variable pulse durations and energies that permit the simultaneous stimulation of different scale dependent features with the reservoir.

7. The method of claim 6, further comprising generating at least one additional electrical pulse for propagating at least one additional electromagnetic wave and acoustic wave at a time substantially after the first discharge time, so that the first or later acoustic wave is permitted to reach a greater volume of the reservoir while the second or later electromagnetic wave is still causing induced acoustic vibration in the reservoir.

8. The method of claim 3 wherein the first and the second pulse generator are part of an array including a plurality of pulse generators, the method further comprising generating at least one additional electrical pulse for propagating at least one additional electromagnetic wave at a time after the first time, and propagating at least one additional acoustic wave, so that the first acoustic wave is permitted to reach a greater volume of the reservoir while the first or later electromagnetic wave is still causing induced acoustic vibration in the reservoir.

9. The method of claim 8 wherein the at least one porous zone comprises at least two spaced apart porous zones, the method further comprising activating the plurality of pulse generators at selected times, said times being selected for enabling an acoustic and an electromagnetic wave from different pulse generators to arrive at each of the at least two porous zones at substantially the same time.

10. The method of claim 3 wherein the said electromagnetic wave, generated from a pulse generator or generators in an array of pulse generators, that reaches the at least one porous zone causes a vibration that has a finite time duration such that the acoustic wave generated from the first pulse generator can pass a given location in the at least one porous zone while the ultrasonic vibration induced by the electromagnetic pulse is still active.

11. The method of claim 3 wherein the first and the second pulse generator are part of an array including a plurality of pulse generators, the method further comprising generating multiple electromagnetic waves at the same time, but with variable pulse durations and energies that permit the simultaneous stimulation of different scale dependent features with the reservoir by electromagnetically-induced acoustic vibration.

12. The method of claim 2 wherein the acoustic wave is generated by an electrohydraulic discharge device contained within a sleeve of suitable material that allows propagation of the acoustic wave, but prevents interaction of a coupling fluid used in the generation of the acoustic wave with the fluids surrounding the electrohydraulic discharge device in the wellbore.

13. The method of claim 1 further comprising generating the acoustic wave in a second borehole different from the first borehole.

14. The method of claim 1 wherein a difference between the first time and the second time is selected based upon a velocity of propagation of the acoustic wave in the formation.

15. The method of claim 1 further comprising introducing a material selected from (i) steam, (ii) water, (iii) a surfactant, (iv) diluent, and, (v) $CO_2$ into the subterranean formation, said introduced material further enabling at least one of (A) increased mobility of the reservoir fluid, and, (B) increased flow of the reservoir fluid.

16. The method of claim 15 wherein introducing the introduced material into the formation further comprises injecting said material in an injection well.

17. The method of claim 1 wherein the said first electromagnetic wave that reaches the at least one porous zone causes a vibration that has a finite time duration such that the acoustic wave can pass a given location in the at least one porous zone while the electromagnetic vibration is still active.

18. The method of claim 1 wherein the electrical pulsed discharge generates the electromagnetic wave using a magnetic pulse generator that discharges electricity into a single- or multiple-turn coil, thus producing an electromagnetic wave, but produces no direct acoustic wave.

19. The method of claim 1 wherein the pulsed electric discharge is initiated using a filament of flexible conductive material that extends across a gap between a pair of electrodes and reduces wear on the electrodes during discharge, said filament being replaced after each discharge through an automated spooling feed device that feeds new filament into the discharge gap through a hole in one of the electrodes.

20. The method of claim 1 wherein the pulsed electric discharge is initiated using a pencil-shaped filament of rigid conductive material that extends across a gap between a pair of electrodes and reduces wear on the electrodes during discharge, said filament being replaced after each discharge through an automated feed device that feeds new filament into the discharge gap through a hole in one of the electrodes.

21. The method of claim 1 wherein the pulsed electric discharge is initiated using a jet of combustible gas that extends across a gap between pair of electrodes and reduces wear on the electrodes during discharge, said gas being applied under pressure through a hole in one of the electrodes.

22. The method of claim 1 wherein the electrical pulse is produced by an electrical pulse discharge device is contained within a packer assembly, said packer assembly being designed to isolate the discharge device from the rest of the wellbore, and with inflow and outflow fluid lines so as to provide recirculation of fluids around the discharge device in the packed off interval, and to apply and maintain positive fluid pressure to improve the coupling of the acoustic wave to the wellbore.

23. The method of claim 1 wherein the electrical pulsed discharge is generated using a reflecting cone that allows the acoustic wave to be directed at a given azimuth or range of azimuths, said reflecting cone also being designed to focus the acoustic energy at a given inclination from the wellbore and also being controlled such that the energy can be redirected to different azimuths from time to time during operation by repositioning of the reflecting cone through a remote control.

24. The method of claim 1, the method further comprising controlling the pulse characteristics of the electromagnetic wave so that an acoustic vibration induced by the electromagnetic wave in the reservoir produces vibration frequencies that are optimized to enhance stimulation at a given scale of inclusion in the reservoir including (i) the pore scale, (ii) the grain scale, (iii) the flat crack scale, (iv) the fracture scale, (v) the lamina scale, (vi) the bedding scale, (vii) the reservoir body length scale, or (ix) any other scale appropriate for stimulation of reservoir fluid production.

25. The method of claim 1 wherein the desired constituent is selected from the group consisting of oil, natural gas, methane, condensate, casing head gasoline, nitrogen, argon, helium, oxygen, hydrogen sulfide, carbon dioxide, sulphur dioxide, boron, vanadium, nickel, sulphur, and asphaltene.

* * * * *